US010702870B2

(12) United States Patent
Schryver

(10) Patent No.: US 10,702,870 B2
(45) Date of Patent: Jul. 7, 2020

(54) THERMAL ENERGY TRANSFER DEVICE

(71) Applicant: Biocision, LLC, Mill Valley, CA (US)

(72) Inventor: Brian Schryver, Redwood City, CA (US)

( * ) Notice: Subject to any disclaimer, the term of this patent is extended or adjusted under 35 U.S.C. 154(b) by 526 days.

(21) Appl. No.: 14/104,850

(22) Filed: Dec. 12, 2013

(65) Prior Publication Data

US 2014/0165645 A1 Jun. 19, 2014

Related U.S. Application Data

(60) Provisional application No. 61/736,907, filed on Dec. 13, 2012.

(51) Int. Cl.
*B01L 7/00* (2006.01)
*B01L 9/06* (2006.01)

(52) U.S. Cl.
CPC *B01L 7/00* (2013.01); *B01L 9/06* (2013.01); *B01L 2300/1805* (2013.01); *B01L 2300/1883* (2013.01)

(58) Field of Classification Search
CPC ..... F28F 2013/005; F24F 13/224; B01L 9/06; B01L 7/00; B01L 2300/1805; B01L 2300/1883; F25D 3/08
See application file for complete search history.

(56) References Cited

U.S. PATENT DOCUMENTS 2,956,686 A * 10/1960 Garey ..... B01L 9/06 211/74
3,744,661 A * 7/1973 Fischer, Jr. ..... B65D 1/24 206/446
4,501,360 A * 2/1985 Levy ..... B01L 9/06 206/1.5
4,932,533 A * 6/1990 Collier ..... A61B 10/0096 206/370
5,863,507 A * 1/1999 James ..... B01L 7/00 422/562
6,106,784 A * 8/2000 Lund ..... B01L 3/50851 219/428
6,323,501 B1 * 11/2001 White ..... G21F 5/015 250/423 R
6,657,169 B2 * 12/2003 Brown ..... B01L 7/52 219/385
7,682,565 B2 * 3/2010 Linton ..... B01L 3/5025 422/552
2011/0009295 A1 * 1/2011 Bodenstaff ..... B01J 19/0046 506/23

(Continued)

FOREIGN PATENT DOCUMENTS

WO WO 2011055694 A1 * 5/2011 ..... B01L 7/00

OTHER PUBLICATIONS

WO 2011055694 , Yamashita, Machine Translation of Description.*

*Primary Examiner* — Devon Russell
(74) *Attorney, Agent, or Firm* — David R. Conklin; Kirton McConkie

(57) ABSTRACT

A portable heat transfer device for transferring thermal energy to and/or from laboratory tubes, clinical vials, specimen vials, laboratory vials, serum vials, drug vials and laboratory containers is provided. The heat transfer device comprises an insulated, thermally conductive heat conduit system and base for the purpose of exchanging heat between the laboratory container and a thermoregulatory device.

18 Claims, 9 Drawing Sheets

(56) References Cited

U.S. PATENT DOCUMENTS

| | | | | |
|---|---|---|---|---|
| 2011/0152128 | A1* | 6/2011 | Herrmann | B01L 3/50855<br>506/40 |
| 2012/0181285 | A1* | 7/2012 | Krauss | A61J 1/16<br>220/507 |
| 2012/0219473 | A1* | 8/2012 | Ishii | B01L 7/00<br>422/561 |

* cited by examiner

700

THERMAL ENERGY TRANSFER DEVICE

RELATED APPLICATION

This application claims priority to U.S. Provisional Patent Application Ser. No. 61/736,907, filed Dec. 13, 2012 and titled THERMAL ENERGY TRANSFER DEVICE, which is incorporated herein by reference in its entirety.

FIELD OF THE INVENTION

The invention relates to heat transfer devices and methods for using the same. In particular, some aspects of the heat transfer devices are adapted to be used with various laboratory sample containment tubes in conjunction with thermoregulatory devices.

BACKGROUND OF THE INVENTION

Temperature control is necessary for many laboratory specimens and is often critical for biological samples for which permanent changes in the sample integrity may occur when stored under improper conditions. While refrigeration and freezing are adequate solutions for temporary or archival storage, temperature management for samples becomes more challenging under conditions where the samples are in the open, as when being manipulated on the laboratory bench. Under these working conditions, biological samples are often maintained at lower temperatures between 0 degrees Celsius and 5 degrees Celsius by inserting the sample vessels into crushed ice. This practice, while effective in maintaining a reduced temperature, has multiple disadvantages including sample vessel instability and visual disarray as the ice melts, leading to sample spillage and loss, potential contamination of the sample, identification error, and exposure of the sample to elevated temperatures.

As an alternative to this method, thermo-conductive racks into which laboratory containers and tubes are inserted may be used in conjunction with ice to provide stability and organizational efficiency. Thermo-conductive racks can interface with alternative thermoregulatory devices, including phase transition gels, chemical heat packs, dry ice, liquid nitrogen, mechanically refrigerated devices, electric thermoregulated devices, passive thermal masses and water baths. For applications that require temperatures below room temperature and portability, thermo-conductive racks can be used in conjunction with thermal reservoirs which can maintain a narrow temperature range by incorporating a material undergoing a phase transition of a substance from solid to liquid. Thermal regulators of this nature may comprise a phase transition medium enclosed in a plastic housing that is molded to a configuration that will receive the laboratory container tubes into recesses directly. Alternatively, thermal regulators may comprise a thermo-conductive rack typically constructed from a metal into which the container tubes are inserted and which serves to transmit environmental heat influx into the tubes directly to the phase change medium, which may be enclosed in a variety of containers (see the CoolRack™ line of products offered by Biocision LLC).

Thermo-conductive racks typically comprise a solid alloy block into which wells are introduced by machine operations for the purpose of receiving the sample vessels. This method of construction is cost-effective and highly functional under most working conditions. Limitations in solid alloy block construction become apparent for specific size ranges and operation conditions. Although thermo-conductive aluminum alloys have a relatively low density, for larger sample tubes or for larger sample arrays, the mass of the rack can exceed a comfortable handling limit for the operator. In addition, where the sample vessels are longer in length, sample rack height can extend above surrounding containment vessels such as ice buckets. Under this condition, air that is in contact with the elevated surface of the rack will cool and increase in density. The cool air in the absence of containment will flow downward and be replaced by air with a greater temperature. The continuous flow of warm air on the samples will place a substantial burden on the thermoregulatory device and increase the thermal gradient within the sample rack. Thermo-conductive racks can exhibit other undesirable properties during use, such as the collection of atmospheric condensate on the exterior surface at lower temperatures that may lead to local liquid water accumulation and degrade the secure grip friction properties of the tool.

Therefore, there is a need for a portable thermo-conductive laboratory sample rack that provides for the transfer of thermal energy to and from a sample vessel and a thermoregulatory device, that provides the temperature control properties of a solid thermally conductive rack, that has a reduced mass when compared to a thermally conductive rack of the same dimensions, and ideally has a means to reduce heat exchange with the environment. This invention meets these needs.

SUMMARY OF THE INVENTION

The present invention provides a device for holding laboratory sample containers ("vessels") that comprises a thermo-conductive core composed of vertical columns of thermo-conductive material shaped for close proximity contact to the external sides of a sample vessel. The vertical columns are joined to a base plate (which may make contact with the bottom of the sample vessels) at the upper surface of the base plate, forming a thermal energy conductive pathway to the undersurface of the base plate and through the undersurface to the thermo-regulatory device on which the core is placed. The device further comprises an enclosure of insulating material that surrounds the core and isolates the exterior surfaces of the core (other than the undersurface of the base plate) from the environment. When the base is placed in contact with a thermoregulatory device, the core will establish a shallow temperature gradient that is close to the temperature of the base. Environmental heat influx into the sample vessel will be conducted across any air gap to the thermally conductive lining of the vertical columns of the core, to the base, and to the thermoregulatory device.

In some embodiments, the vertical columns of the core are tubes in which the sample vessel sits. In some embodiments, the inner walls of the tube surround the sample vessel on all sides, making close contact therewith, while in other embodiments, there is a gap between at least some portion of the sample vessel and the inner walls of the tube. In some embodiments, the sample vessel is suspended in a tube by its cap or a flange underneath the cap. In other embodiments, the vertical columns are solid, and the sample vessel is positioned between them. In any of these embodiments in which there is a gap between the sample vessel and the vertical column, the gap will generally be less than 0.25 inches, and will often be less than 0.1 inches.

In some embodiments, the thermally conductive columns are composed of a metal or metal alloy, including, but not limited to, aluminum, aluminum alloy, copper, copper alloy, stainless steel, zinc, zinc alloys, and titanium. In some embodiments, the thermally conductive columns are bonded to the base by an interference friction fit, screw fastener, rivets, spring fastener, solder joint, braze weld, fusion weld, or adhesives.

In some embodiments, the thermally conductive columns and base are corrosion-protected by anodization, chemical passivation, chromate conversion coating, powder paint coating, spray paint or sealant coating, or sealant dip coating.

In some embodiments, the thermo-conductive columns and base form an air-tight well that will fill with dense cold air to act as both a conductor of thermal energy from the sample to the thermo-conductive lining and an insulation barrier restricting warm air contact with the sample vessel walls. In other embodiments, the insulating material surrounding the thermally conductive lining is seal-bonded to the base thereby creating an air-tight well containing the sample vessels.

In some embodiments, the insulating material is permanently bonded to the thermally conductive columns and the base, while in other embodiments, the insulating material is removable and intermittently bonded to the thermally conductive lining by friction-fit, magnets, screw fasteners, hook and loop fabrics, spring clips, or by interlocking features.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Figure 1:
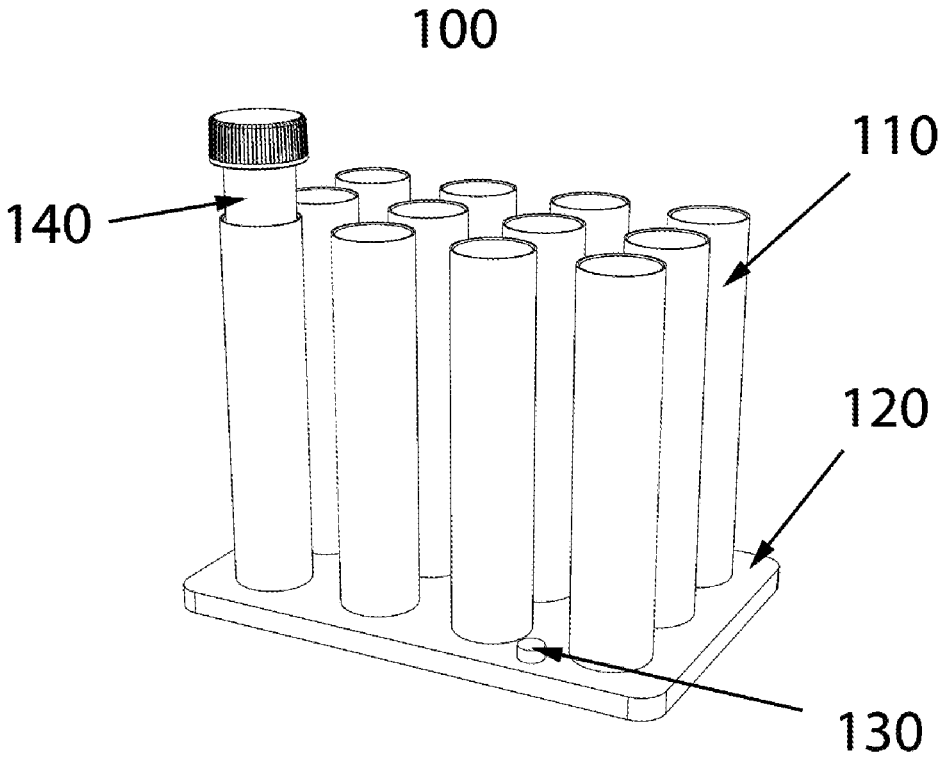
FIG. 1 shows the thermo-conductive core element of an embodiment of the device of the invention for use with 15 ml capacity conical-end sample vessels or sample tube vessels of similar diameter. The thermo-conductive columns in this embodiment comprise a tubular segment that is bonded to the base plate by an interference friction fit.

There is a frequent need in biotechnical, medical, and clinical laboratories, and in clinical and medical centers, for both stationary and portable cooling of sample vessels, including sample test tubes, centrifuge tubes, microfuge tubes, blood sample tubes, serum vials, cryogenic sample vials, and reagent bottles. A common practice for cooling the vessels is to insert the vessels into crushed or flaked ice contained in a larger pan or bucket. This method has multiple disadvantages in that, as the ice melts, sample tubes will lean to the side and eventually become submerged in the ice melt. This event introduces the problems of sample spillage, contamination, misidentification, loss, and degradation.

The use of thermo-conductive racks such as the Cool-Rack™ products sold by BioCision LLC, offers a solution to this problem. The thermo-conductive racks are designed to receive the sample vessels in a safe and rigid array configuration, and to conduct sample heat to and from a thermoregulatory device. Thermoregulatory devices may include, but are not limited to ice, phase-change reservoirs, water baths, refrigeration devices, peltier coolers, heat exchangers, heat tubes, dry ice and liquid nitrogen. The thermo-conductive vessel racks are typically constructed from a metal alloy that has a thermo-conductivity of 10 Watts per meter-second or greater. As the thermo-conductive racks are typically portable devices, to limit the overall mass of the rack, a metal alloy with a low density and a high thermo-conductivity is a desirable material for the construction of the racks. Despite the use of low density alloys such as aluminum alloys, racks of larger array dimensions and racks designed to receive longer sample vessels may require alloy volumes that present burdensome and difficult to manage masses to the user. In addition, due to the heat capacity of the alloy material, the larger rack masses contain significant amounts of heat that must be removed to chill the racks to the desired operation temperature.

Thermo-conductive racks also have a disadvantage in that the highly conductive material, when exposed to the environment, will readily conduct environmental heat from the environment to the thermoregulatory device, thereby introducing additional thermal burden on the thermoregulatory device. When the thermo-conductive racks are used inside a secondary containment vessel such that the top surface of the rack is lower than the surrounding walls of the container, such as an ice pan or ice bucket or a phase-change reservoir with surrounding insulation walls, such as with the Cool-Box™ products sold by Biocision LLC, the air between the thermo-conductive rack and the container walls becomes chilled and increased in density. The higher density air remains confined in the well of the container by gravitation and effectively insulates the thermo-conductive rack from the environment. If, however, the thermo-conductive rack extends in height above the container walls, the air that becomes chilled after contact with the rack will descend in a gravitational field and flow over the container wall. The induced air flow will replace the chilled air with warmer environmental-temperature air resulting in a continuous flow of warm air on the rack, thereby imposing a continuous thermal energy influx. As the thermal energy influx will be transferred to the thermoregulatory device, a rack that is elevated above the container wall introduces an added burden to the heat absorbing capacity of the thermoregulatory device. An over-loaded thermoregulatory device may result in an equilibrium temperature that is greater that the desired temperature in the sample vessel, a reduced service interval from the thermoregulatory device, or an increase in the energy requirement for powering the thermoregulatory device.

Therefore, there is a need for a thermo-conductive rack that has a minimal mass and has a minimal influx of environmental heat. This invention meets these needs. Devices of this invention comprise a core of thermoconductive material with at thermal conductivity greater than 10 Watts per meter-degree Kelvin that surrounds a majority of the sample vessel surface area on the sides. The surrounding thermo-conductive material is of sufficient thickness to provide adequate thermal energy transfer, with typical material thickness ranging from 0.013 inches to 0.60 inches. The surrounding thermo-conductive is in direct contact with the upper surface of a base that is also constructed from thermo-conductive material. In some embodiments, the surrounding thermo-conductive material is bonded to the base by an interference fit into a recess in the surface of the base, or over a protrusion from the base surface. In other embodiments, the surrounding thermo-conductive material is bonded to the base by other means including, but not limited to adhesives, screws, spring clips, snap rings, magnets, interlocking channels, dove-tail joints, solder joints, braze welding, fusion welding, and thread features. As the interior volume of the sample wells formed by the thermo-conductive material may be colder in temperature than the environmental temperature, the gas within the well may be denser than the atmosphere and therefore will leak from the cavity if the sample well is not airtight. Such leaks will introduce warmer atmospheric air into the well cavity thereby raising the temperature and degrading the cooling capacity of the device. Therefore in some embodiments the sample cavities formed by the thermo-conductive material the vertical walls of the cavity will be sealed to the thermoconductive base in a gas-tight joint. In some embodiments, the vertical thermo-conductive walls will be sealed to the base forming an air-tight cavity using sealant materials or adhesives, gaskets, 0-rings, close tolerance friction fitting, solder joints, braze welds, or fusion welds.

In some embodiments, the surrounding thermo-conductive material is constructed from a tubular segment while in other embodiments, the surrounding thermo-conductive material is a segment of an extrusion with single or multiple cavities for receiving the sample vessels. In other embodiments, the surrounding thermo-conductive material and the base comprises a fused array of wells with and attached base that is machined from a solid block of material.

In some embodiments, the undersurface of the base directly interfaces to a thermoregulatory device by contact of planar surfaces and held in contact by gravitational forces. In other embodiments, the base is temporarily fastened to the thermoregulatory device by means including, but not limited to magnetic attraction, clips, spring fasteners, interlocking channels, snap hooks, dove-tail joints, and screws.

The thermo-conductive material is enclosed by an insulating housing that is constructed from materials with a thermal conductivity below 1 Watt per meter degree Kelvin, including, but not limited to, polyethylene foam, polyurethane foam, vinyl foam, styrene foam. In some embodiments, the insulating material is in direct contact with the surrounding thermo-conductive material, while in other embodiments, the insulating material is recessed from the surrounding thermo-conductive material. In other embodiments, the insulating material forms a shell housing that surrounds the periphery of the thermo-conductive column array. In some embodiments, the thermo-conductive material surrounding the sample vessel cavity extends to the top surface of the surrounding insulation while in other embodiments, the thermo-conductive material is recessed below the top of the sample cavity.

As the devices of the invention are intended to be used at temperatures that differ from ambient temperature, under conditions where the temperature is lower that ambient temperature, atmospheric moisture may condense on the cold surfaces of the core components. As the moisture condensate aggregates to droplets, there is the opportunity for surface tension to draw the moisture into the spaces between the core material and the insulation housing. In addition, under normal conditions of use in a laboratory or clinical environment, there are frequent opportunities for spilled liquids to come in contact with the device and be drawn or flow into the spaces between the core and the insulation cover. To maintain cleanliness of the device and eliminate opportunities for bacterial, mold, or fungal growth, it may be desirable, in some embodiments, to provide a means for disassembling the insulation from the core and clean the two parts. In other situations, where the insulation housing becomes degraded through use or accident, it would be desirable to remove the insulation housing from the core easily and install a replacement part. Therefore, a means of reversibly securing the insulation housing to the thermo-conductive core would be useful, and the present invention provides devices comprising such means.

In some embodiments, the insulating material is temporarily bonded to the thermo-conductive columns or to the base or to both the thermo-conductive columns and the base a means including, but not limited to, magnets, interference friction fit, spring clips, snap fasteners, hook and fiber linkage, interlocking features, or screws. In other embodiments, the insulating material is permanently bonded and sealed to the surrounding thermo-conductive material or the base or both by an adhesive join.

The present invention will be described with regard to the accompanying drawings that assist in illustrating various features of the invention. In this regard, the present invention generally relates to heat transfer devices for use with laboratory tubes, specimen vials, drug vials, and clinical sample vials.

FIG. 1 shows the core thermo-conductive element of an embodiment of the device of the invention for use with 15 ml capacity conical-end sample vessels or sample tube vessels of similar diameter. The core assembly 100 comprises an array of twelve tubes 110 with an inside diameter of 0.688 inches constructed from an aluminum alloy with a wall thickness of 0.030 inches to 0.100 inches and bonded with an interference fit into cylindrical hole recesses to a depth of 0.125 inches in a base plate 120 that is also constructed from an aluminum alloy. The base plate comprises two magnetic discs 130, for the purpose of removable attachment of an insulating foam housing (not shown). The magnets are bonded by interference fit or adhesive material in a cylindrical recess with a depth of 0.125 inches. The upright tubes 110 receive the 15 ml centrifuge tubes 140. Environmental heat that enters the sample vessels is readily transferred due to temperature differential between the sample tubes and the core tubes, through the core tube to the base, and from the base to the thermo-regulatory device to which the base undersurface is in direct contact.

Figure 2:
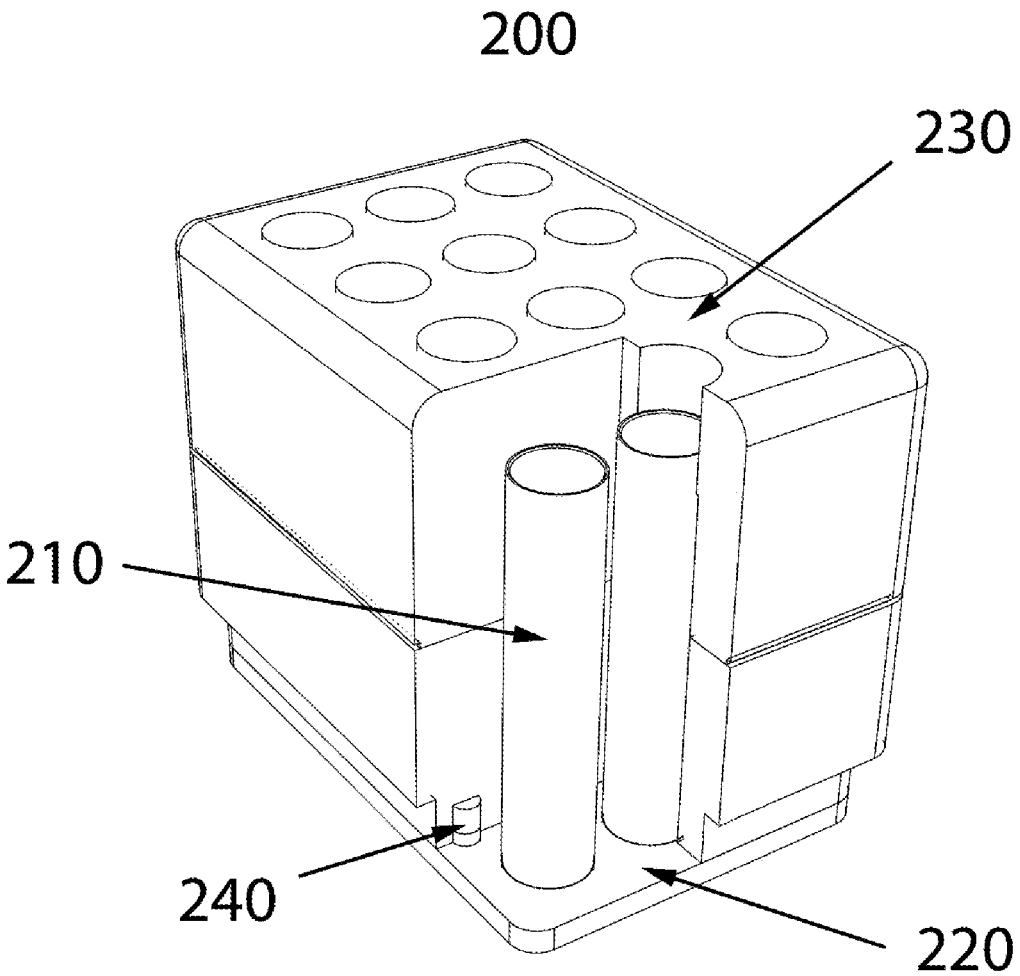
FIG. 2 shows a partial cross-section of the thermo-conductive core of the device in FIG. 1 with the insulation housing in place.

FIG. 2 shows the thermo-conductive tubes and base in FIG. 1 as 210 and 220 surrounded by an insulation housing 230 that is attached by magnet pairs 240 that are embedded in the insulation housing and the base.

Figure 3:
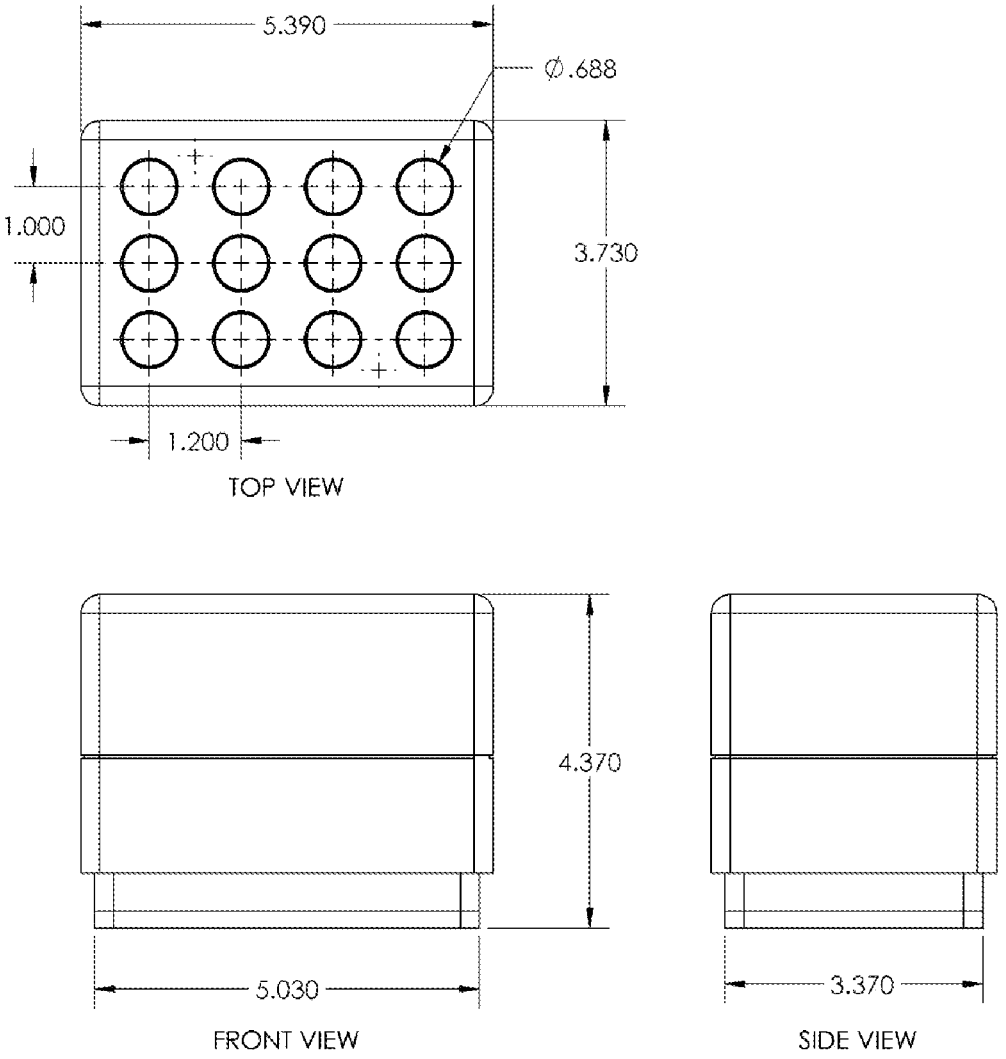
FIG. 3 shows the overall dimensions of the device in FIGS. 1 and 2.

The device shown in FIGS. 1 and 2 has the over-all dimensions shown in FIG. 3 with outside rectangular dimensions of 5.39 in length and 3.73 inches in width. The base has dimensions of 5.03 inches by 3.37 inches. The height of the device including base thickness is 4.37 inches.

Figure 4:
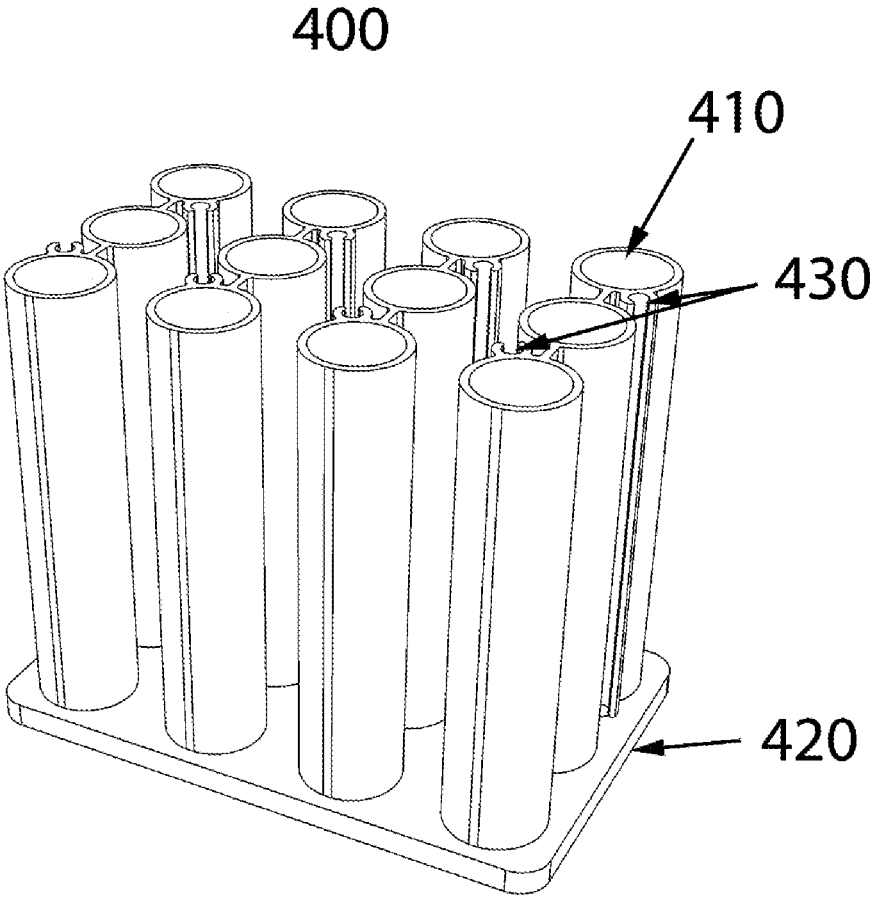
FIG. 4 shows a second embodiment of a thermo-conductive core of a device of the invention for use with 15 ml capacity conical-ended sample vessels or sample tubes of similar diameter. The thermo-conductive columns in this embodiment comprise an aluminum extrusion that is attached to the base plate by screws that engage an extruded screw boss feature.
Figure 5:
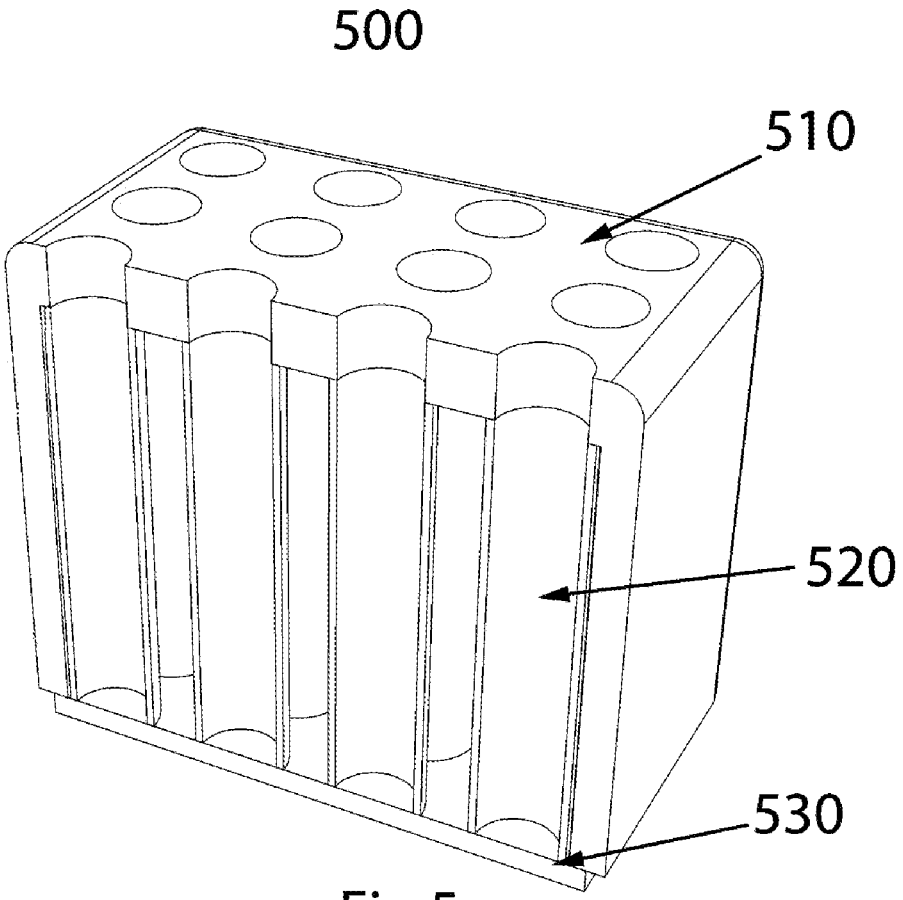
FIG. 5 shows a cross-section of the thermo-conductive core of the device in FIG. 4 with the insulation housing in place.
Figure 6:
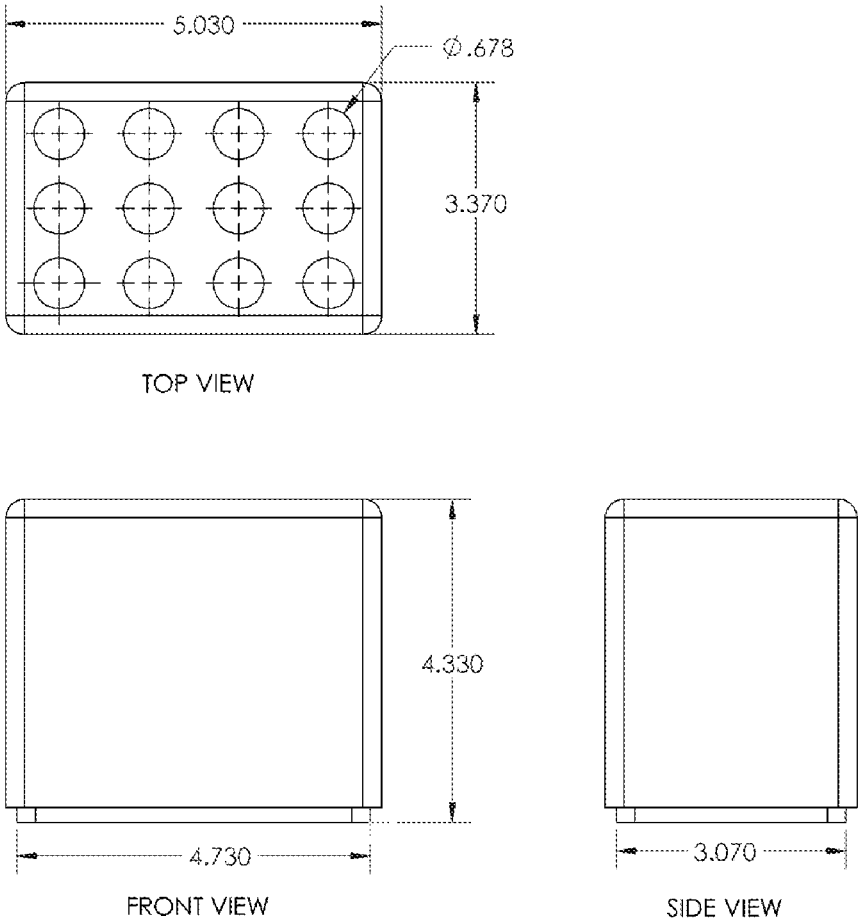
FIG. 6 shows the overall dimensions of the device in FIGS. 4 and 5.

A second embodiment of a device of the invention is shown in FIGS. 4 through 6. In FIG. 4, a thermo-conductive core 400 comprising four segments of an aluminum extrusion 410 are shown. The extrusion segments are each fastened to the base plate 420 by two screws that engage the screw boss features 430 that are integrated into the extrusion.

FIG. 5 shows the core comprising the extrusion segments 520 and the base plate 530 of FIG. 4 covered by an insulating shell housing 510.

The device in FIGS. 4 and 5 has the over-all dimensions shown in FIG. 6 with outside rectangular dimensions of 5.03 in length and 3.37 inches in width. The base has dimensions of 4.73 inches by 3.07 inches. The height of the device including base thickness is 4.33 inches.

Figure 7:
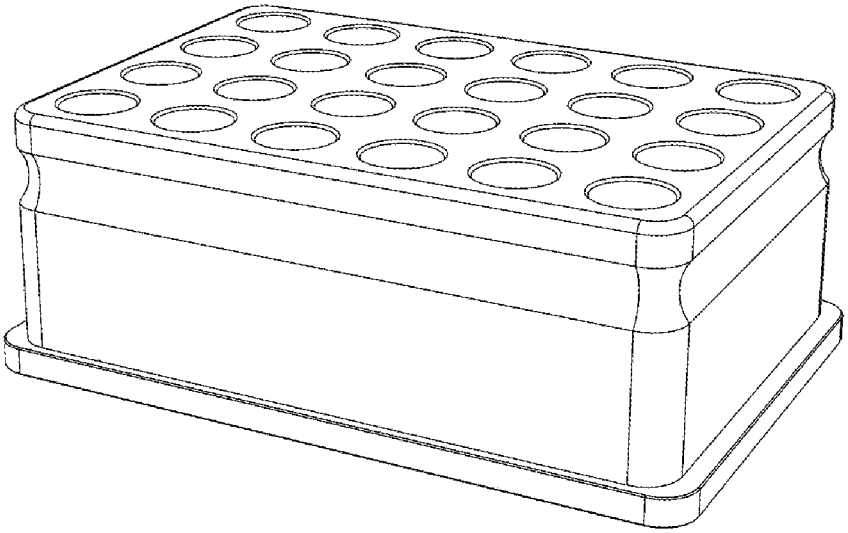
FIG. 7 shows a third embodiment of a thermo-conductive core of a device of the invention for use with 1 ml to 2 ml capacity sample vessels. The thermo-conductive columns and base in this embodiment are machined from a solid block as a singular unit.

FIG. 7 shows a third embodiment of a device of the invention and illustrates how the invention provides thermo-conductive cores for sample vessels of smaller size and greater array density. The device has a core 700 comprising the surrounding thermo-conductive material and a base that may be constructed as an integral unit that is machined directly from a block of thermo-conductive alloy.

Figure 8:
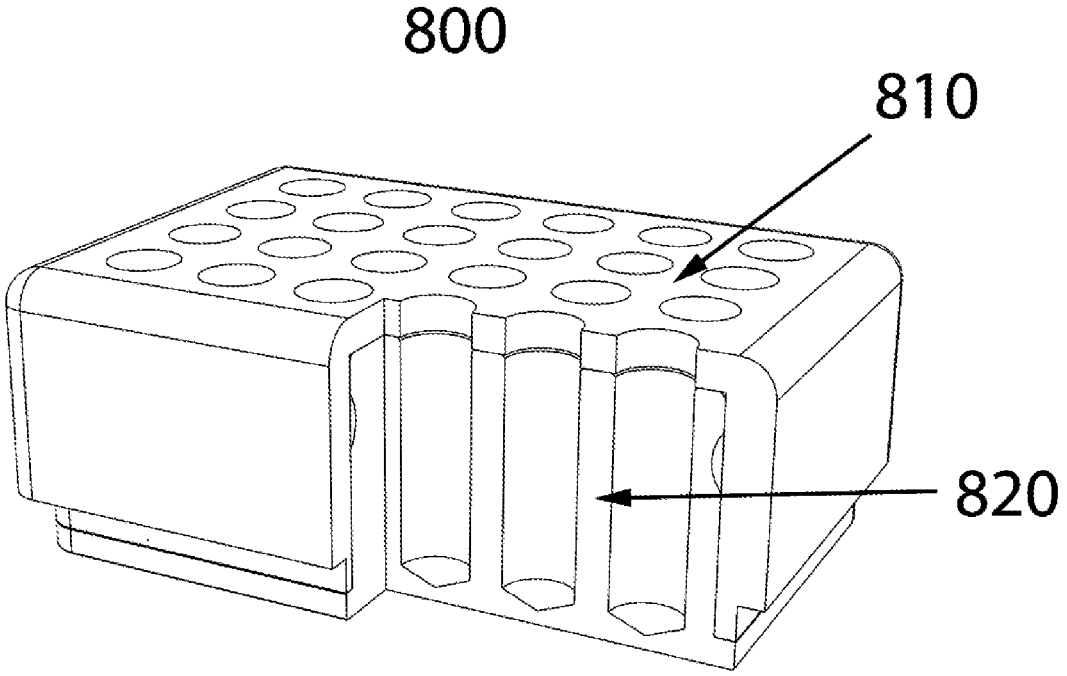
FIG. 8 shows a partial cross-section of the thermo-conductive core of the device in FIG. 7 with the insulation housing in place.

FIG. 8 shows the thermo-conductive core in FIG. 7 as 820 encased in an insulating shell 810. The shell is removable and bonded by a slip friction fit to the core.

Figure 9:
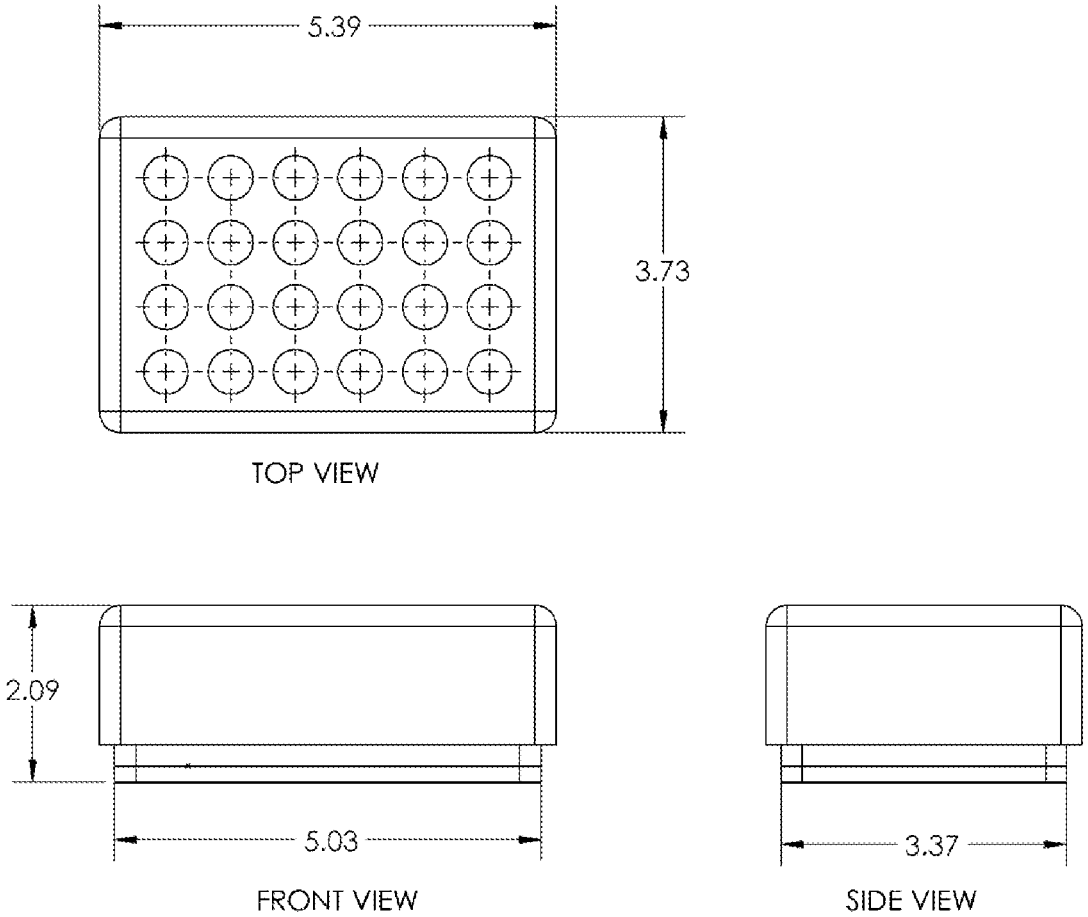
FIG. 9 shows the overall dimensions of the device in FIGS. 7 and 8.

The device in FIGS. 7 and 8 has the over-all dimensions shown in FIG. 9 with outside rectangular dimensions of 5.39 inches in length and 3.73 inches in width. The base has dimensions of 5.03 inches by 3.37 inches. The height of the device including base thickness is 2.09 inches.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A device for transferring thermal energy from sample vessels to a thermoregulator, said device comprising:

a thermo-conductive core comprising a base plate composed of a thermo-conductive material having an upper surface and further comprising an array of vertically extending hollow thermo-conductive columns each having an equal and constant outer diameter along an entirety of a height of each thereof and each having a terminal end coupled to the upper surface of the base plate, each having an outer surface that is spatially separated from an outer surface of adjacent thermo-conductive columns thereby forming a void between the adjacent outer surfaces, between the outer surfaces, and between the upper surface, each vertically extending hollow thermo-conductive column further comprising an opening located opposite the terminal end, and an inner surface configured to contact a sample vessel; and a single insulating material having an array of cylindrical holes corresponding to the array of vertically extending hollow thermo-conductive columns and arranged to receive the array of vertically extending hollow thermo-conductive columns such that the insulating material entirely fills the void, such that the single insulating material contacts and encloses the upper surface of the base plate, and each outer surface of each vertically extending hollow thermo-conductive column, an outer surface of the single insulating material forming an exterior surface of the device.

2. The device of claim 1, wherein the thermo-conductive material is a metal or metal alloy.

3. The device of claim 2, wherein the thermo-conductive material is aluminum, an aluminum alloy, copper, copper alloy, stainless steel, titanium, zinc, or zinc alloy.

4. The device of claim 1, wherein the insulating material is reversibly attached to the thermo-conductive core by magnets, spring clips, snap connectors, fiber and hook, interference friction fit, interlocking features, or screws.

5. The device of claim 1, wherein the thermo-conductive columns comprise one or more tube segments.

6. The device of claim 5, wherein the tube segment is bonded to the base by an interference friction fit, fusion weld, braze joint, solder joint, screw thread, snap ring, or adhesive bond.

7. The device of claim 1, wherein the insulating material is polyethylene foam, urethane foam, vinyl foam, styrene foam.

8. The device of claim 1, wherein the insulating material is a solid polymer.

9. The device of claim 1, wherein the insulating material is permanently bonded to the thermo-conductive core by adhesive joints.

10. The device of claim 1, wherein the insulating material is molded onto the core.

11. The device of claim 5 wherein the insulating material is polyethylene foam, urethane foam, vinyl foam, styrene foam.

12. The device of claim 5, wherein the insulating material is a solid polymer.

13. The device of claim 5, wherein the insulating material is removably attached to the thermo-conductive core by means of a friction fit or by magnetic attraction.

14. The device of claim 5, wherein the insulating material is permanently bonded to the thermo-conductive core by adhesive joints.

15. The device of claim 5, wherein the insulating material is molded onto the core.

16. The device of claim 1, wherein the inner surface further comprises an equal and constant inner diameter along the entirety of the height of each thereof.

17. The device of claim 1, wherein the terminal end is closed.

18. A device for transferring thermal energy from sample vessels to a thermoregulator, said device comprising:

a thermo-conductive core comprising an array of adjacent vertically extending hollow thermo-conductive columns, each column having a closed end, an open end, an inner surface configured to contact a sample vessel, an outer surface, and an equal and constant outer diameter along an entirety of a height of each column, said hollow thermo-conductive columns being arranged such that the outer surface of each column is spatially separated from the outer surface of at least two adjacent columns in the array thereby forming a void between the adjacent outer surfaces;

a base plate composed of a thermo-conductive material, to which said closed end of said columns are attached to an upper surface thereof, said void further comprising an area between the outer surface and the upper surface of the base plate; and a single insulating material entirely filling the void, an outer surface of the single insulating material forming an exterior surface of the device.

* * * * *